US007201605B2

(12) United States Patent
Yamada et al.

(10) Patent No.: US 7,201,605 B2
(45) Date of Patent: Apr. 10, 2007

(54) ELECTRIC CONNECTOR

(75) Inventors: Shoji Yamada, Yamato (JP); Takeshi Hashimoto, Yamato (JP)

(73) Assignee: Quasar System Inc., Yamato-shi (JP)

( * ) Notice: Subject to any disclaimer, the term of this patent is extended or adjusted under 35 U.S.C. 154(b) by 0 days.

(21) Appl. No.: 11/324,313

(22) Filed: Jan. 4, 2006

(65) Prior Publication Data

US 2006/0172590 A1 Aug. 3, 2006

(30) Foreign Application Priority Data

Feb. 1, 2005 (JP) ..... 2005-024783

(51) Int. Cl.
*H01R 12/24* (2006.01)

(52) U.S. Cl. ..... 439/495

(58) Field of Classification Search ..... 439/59–62, 439/492–495, 499
See application file for complete search history.

(56) References Cited

FOREIGN PATENT DOCUMENTS

JP 2002-246086 8/2002

OTHER PUBLICATIONS

English Language Abstract of JP 2002-246086.

*Primary Examiner*—Khiem Nguyen
(74) *Attorney, Agent, or Firm*—Greenblum & Bernstein, P.L.C.

(57) ABSTRACT

The present invention aims to provide an electric connector which makes it possible to connect easily, hard to separate and enables to maintain good electric connections. The electric connector of the present invention comprises plural contacts 30 each including a contact point 31 contacting each of the plural terminals and an elastic arm part contiguous to the contact 31 and a housing 40 including a reception recess 41 retaining the one end of the circuit board, and attachment recesses 42 for attaching each of the plural contacts, a cover part 43 being laid down toward a direction of insertion of the circuit board, and a pressure part 44 being contiguous to the cover part 43 and being rotatably disposed opposite to the plural contacts 31, wherein the pressure part 44 protrudes into the reception recess 41 as the cover part 43 is laid down.

7 Claims, 6 Drawing Sheets

(a)

(a) (Prior Art)

(b) (Prior Art)

ELECTRIC CONNECTOR

FIELD OF THE INVENTION

The present invention relates to an electric connector used in a mobile terminal device, and more particularly, relates to an electric connector which makes it possible to connect easily, hard to separate and enables to maintain good electric connections.

BACKGROUND ART

Mobile terminal, such as a mobile phone or a PDA (personal digital assistants), uses various small-sized electric connectors, such as a flexible flat cable (FPC)/a flexible print circuit (FPC) connector or connector between substrate.

Referring now to FIG. 1, a conventional FPC electric connector will be explained. A conventional FPC electric connector is mounted on a motherboard and connects electrically with FPC having several terminals at one end. As shown in FIG. 1, the FPC electric connector comprise (a) contact points 2 which are arrayed at specified intervals and that connect directly to a terminal set on the FPC and contacts 1, each of which equips an engage part 3 set on said contact point 2 facing opposite, and (b) a reception recess 11 having aperture facing parallel with a surface of a motherboard, an attachment recess 12 to which several contacts 1 are engaged, a pressure part 13 which engages to an engage part 3 while pressing a FPC 100 inserted into the reception recess 11 toward the contact point with respect to the rotation, a support part (not shown) for rotatably holding the pressure part 13 and a housing 10 comprising a cover 14 contiguous to the pressure part 13 for causing the pressure part 13 rotate.

The FPC 100 is formed by arraying several terminals at a predetermined spacing along with one end surface such that the contact point 2 of each contact 1 is located in the position where the terminals are contacted thereto. FIG. 1 (*a*) shows the condition that the FPC 100 is inserted in the reception recess 11 of the housing 10 while the surface having terminals of the FPC 100 setting below. Thus, the contact point 2 of the contact 1 protrudes upper extending into the reception recess 11 so as to make contacts to the terminal. The contact 1 comprises the contact point 2 as described above, the arm 4 contiguous to the contact point 2 while making movable to the up and down direction, the engage part 3 extending to the reception recess 11 and engaging with the pressure part 13, and the leg part 5 soldered on the contact point set at a predetermined position on the motherboard so as to provide the electrical connection to the motherboard. Prior to the insertion of the FPC 100 into the reception recess 11, the contact point 2 of the contact 1 projects inside the reception recess 11, however, when the FPC 100 is inserted once, the structure allows the terminals to be set on the FPC 100 to urging the contact point 2 downward to make contact under the predetermined contact pressure. The contact 1 under the inserted condition to the FPC 100 creates the elastic force that urges the contact point 2 upward; this makes possible to maintain the stable electrical connection.

The contact 1 may be produced from a conductive thin metal plate by punching into a predetermined figure by presswork processes etc., and then providing appropriate plating. For the thin metal plates, plates of bronze or copper etc. with the thickness of about 0.1 mm~0.3 mm may be used. As the plating, although gold plating is ordinary used, however, considering about corrosion and others, alloy-plating such as nickel-plating or nickel-tin-plating may be used.

The reception recess 11 is configured to have an opening area and depth so as to retain one end to which several terminals are disposed. The attachment recess 12 is configured for allowing the engagement part 3 of the contact 1 to be inserted; to make the contact point 2 movable up and down; and to be soldered to the leg part 5 to the motherboard. Therefore, the attachment recess 12 includes an insertion recess which receives the engage part 3 and an arm part reception recess which has the sufficient space allowing the arm 4 continuous to the contact point 2 to move up and down.

The supporting part (not shown), for example, when the pressure part 13 is shaped to the figure including cantilever protrusions on its both sides, may be a hole accepting the cantilever protrusions; or, when the pressure a part 13 has the structure having holes on its both ends, the supporting part may be construed as a protrusion being inserted into the holes.

The pressure part 13, for example, comprises the plane surface 13*a* and the half-round protrusion 13*b* contiguous to the cover part 14. When the plane surface 13*a* placed opposite to the contact point 2 of the contact 1 which protrudes from the lower side of the reception recess 11, the pressure part 13 does not protrude into the reception recess 11 and rotates about a support part (not shown). As the half-round protrusion 13*b* becomes to the opposite position to the contact point 2, the pressure part 13 protrudes into the reception recess 11 so that the pressure part 13 urges the FPC 100 inserted in the reception recess 11 to the contact point direction. The condition that the FPC 100 is urged to the contact point direction ensures to retain the stable electrical contacts even if the FPC 100 moves up and down directions by vibrations, since the condition allows the FPC 100 to move with keeping the contact between the contact point 2 and the terminals.

The Cover 14, as mentioned above, is continuous to the pressure part 13 and causes the pressure part 13 rotate about a support part (not shown). In FIG. 1(*a*), the protrusion part 13*b* of the pressure part 13 is placed opposite to the contact point 2 prior to the insertion of the FPC 100 and is set to protrude in the reception recess 11 so that the planar surface 13*a* of the pressure part 13 faces opposite to the contact point 2 by moving the cover part upwardly for allowing the FPC to be inserted. After the FPC 100 is inserted, as shown in FIG. 1(*b*), the cover part 14 is inclined to the direction opposite to the insert direction of the FPC 100 so that the cover part 14 overlaps to a part of the FPC 100 while facing the protrusion part 13*b* opposite to the contact point 2 further while extending in the reception recess 11 so as to urge the FPC 100 toward the contact point direction. As shown by the arrow in Fig. (a), the conventional electric connector adopts the structure in that the cover 14 is inclined to the direction opposite to the insertion of the FPC 100. Now, the housing 10 may be formed from plastic materials such as PPS (polyphenylene sulfide) resin, LCP (liquid crystal polymer), polyamide resin, PBT (polybuthylene telephthalate) resin by flow molding using molding frames.

The conventional electric connector has a structure in that the cover part covers the FPC, and is lifted with respect to the insertion direction of the FPC, and then, is laid down in opposite direction to the insertion direction of the FPC.

Hence, the FPC pushes the cover part up when the FPC is pulled around to the upper direction, and this causes problem of causing easy detachment of the FPC thereby resulting in the unstable of connection condition. In order to access to such problem, an electric connector has been proposed so far wherein the directions of lifting up and falling down of the cover are opposite with respect to the conventional one (for example, refer to Patent Literature 1). This electric connector comprises an insulation housing, several terminals attached side-by-side in a predetermined pitch, and an actuator such that the FPC is inserted backward from an insertion slot. The actuator is constructed rotatably by engaging an engage part of which a base part is disposed to the terminal; the actuator can rotate between the first position, which is standing up at the insulation housing and the second position, which is laying down along until the housing while turning backward from the first position. The engage part of the actuator and the terminal includes the structure in that the engaging part of point of the tip portion of the cantilevered engage part extending substantially horizontal toward an insertion slot is inserted in a hole made on a base end of the actuator, and a camshaft disposed at a peripheral edge of a window hole at the lower side of the engage portion.

In the above-described electric connector, an engage tip of terminal has elasticity, and when the actuator is positioned on the first position, a short shaft of camshaft turns to the vertical direction and no power is exerted between the camshaft and the engage tip. When the actuator is turned from the first position to the second position, the long shaft of camshaft rotates toward the vertical direction to provide the elastic force to the engage tip and the elastic force pushes the inserted FPC down through the camshaft so that a predetermined contact pressure between the contact point of the terminal and the FPC may be maintained. In addition, unlike the conventional electric connector, since the directions of lifting up and falling down of the cover are opposite directions each other, even if some powers affect to the directions in which the FPC pulls out, or the FPC is pulled around upward, both actions create the force toward the direction in which the cover falls down, and therefore, the FPC is hard to come off, thereby providing the advantage of making it possible to maintain the stable electric connection.

However, the above conventional electric connector has the structure in which engage tip has elasticity. When cover falls down, the long shaft of the camshaft turns vertical direction and projects into the insertion slot. The engage tip strongly pushes the camshaft to protrude into the insertion slot and this prevent the FPC from insertion, and hence, in order to insert and to attach the FPC, in the same procedure as the conventional electric connector, three process are required for installing thereof comprising the steps of; 1) lifting up cover, 2) inserting FPC to insertion slot, 3) putting down cover. Particularly, it consumes large time for the electric connector, which is produced for use of mobile terminal with small sizes and a thin housing and thin cover piling, to lift up the cover upon the installation. Therefore, a novel connector structure that can perform this process easily or does not need this process is requested so far.

[Patent Literature 1] Japanese Patent Publication No. 2002-246086.

DISCLOSURE OF INVENTION

Problems to be Solved by Invention

An object of the present invention is to provide a connector, being connectable easily, hard to remove and enable to give stable electric connection.

Means for Solving Problems

The present invention has been accomplished by the findings of the inventors in which the cover part is caused to lay down in the same insertion direction of the FPC and the pressure part continuous to the cover part is configured not to project into the recess which receives one end of the FPC when the cover is pulled up, but to project into the recess as the cover is laid down; and an arm continuous to the contact point is configured to have elasticity. By adopting the above construction, the insertion of the FPC without pulling up the cover part causes the top of the FPC contact to the pressure part extended from the pressure part into the reception recess so as to push the cover part up by the rotation of the pressure part with respect to the insertion of the FPC. Even if the force directing to pull off the FPC is exerted, easy pull-off is prevented and hence, the stable electric contact may be attained, since the force directs to the direction in which the rotation of the pressure part lays the cover part down.

According to claim 1 of the present invention, an electric connector for providing electric connection to a circuit board may be provided. The circuit board comprises plural terminals arrayed at one end and with a predetermined spacing, wherein the electric connector comprising;

plural contacts each including a contact point contacting each of the plural terminals and an elastic arm part contiguous to the contact, and a housing including a reception recess retaining the one end of the circuit board, and attachment recesses for attaching each of the plural contacts, a cover part being laid down toward a direction of insertion of the circuit board, and a pressure part being contiguous to the cover part and being rotatably disposed opposite to the plural contacts, wherein the pressure part protrudes into the reception recess as the cover part is laid down.

The electric connector of claim 2, each of the plural contacts comprises an engage part extending an arch like shape and the pressure part comprises plural engage recesses which slidably retains each of the engage part so as to make the pressure part rotate.

The electric connector of claim 3, the pressure part includes cantilevered axis parts at each end surfaces, and the housing supports the axis parts rotatably and includes a support recess for receiving the axis part.

The electric connector of claim 4, the pressure part comprises a first plane surface and rotates adjacent to the circuit board as the circuit board is inserted while being terminated the rotation thereof when the first plane surface becomes adjacent onto the circuit board.

The electric connector of claim 5, the housing comprises a cover part support part and the cover part support part supports lifted the cover part to prevent the cover part from laying down toward a direction of pulling out of the circuit board.

The electric connector of claim 6, wherein the pressure part comprises a second plane surface, and each of the plural contact includes an adjacent surface to the pressure part being contiguous to the engage part and being adjacent to the second plane surface, the rotation of the pressure part is terminated by the adjacent surface to the pressure part of the plural contacts.

The electric terminal of claim 7, the contact comprises a stopper including a protrusion, the attachment recess further comprises a fixing recess being formed to a corresponding shape of the stopper with the protrusion.

Advantage of Invention

An electric connector of the present invention makes it possible to connect the circuit board easily without pulling up the cover part, and when connected, the circuit board is not become apart easily thereby providing the stable electric connection. In addition, since the present invention can provide the stable electric connection without taking apart easily, connectors with smaller pitches can be provided thereby improving processing capability.

BRIEF DESCRIPTION OF DRAWINGS

The above and other objects of the present invention will be recognized by referencing to the description taken in connection with the accompanying drawings, in which.

EXPLANATION OF NUMERALS

1—contact
2—contact point
3—engage part
4—arm part
5—leg part
10—housing
11—reception recess
12—installation recess
13—pressure part
13*a*-plane surface
13*b*-trotrusion part
14—cover part
20—circuit board
21—one surface
22—another surface
23—terminal
30—contact
31—contact point
32—arm part
33—leg part
34—engage part
35—adjacent surface to pressure part
36—protrusion
37—stopper
40—housing
41—reception recess
42—installation recess
43—cover part
43*a*-window
44—pressure part
44*a*-axis part
44*b*-end surface
45—second plane surface
46—first plane surface
48—cover part support part
100-FPC

BEST MODE FOR PRACTICING INVENTION

The electric connector of the present invention is used to connect electrically a circuit board such as the FPC to the motherboard and is mounted to the motherboard. First, the circuit board will be explained with referring to FIG. 2. On one side 21 of the circuit board 20 described in FIGS. 2(*a*) and (*b*), a circuit (not shown) is formed thereon and on one end of the other side 22, and a plurality of terminals 23 are disposed at a predetermined interval. Each of the terminals 23 is connected to each circuit on the circuit board 20. Transmission of electric signals between the circuit on the circuit board 20 and the circuit on the motherboard is performed through the terminals 23.

Figure 2:
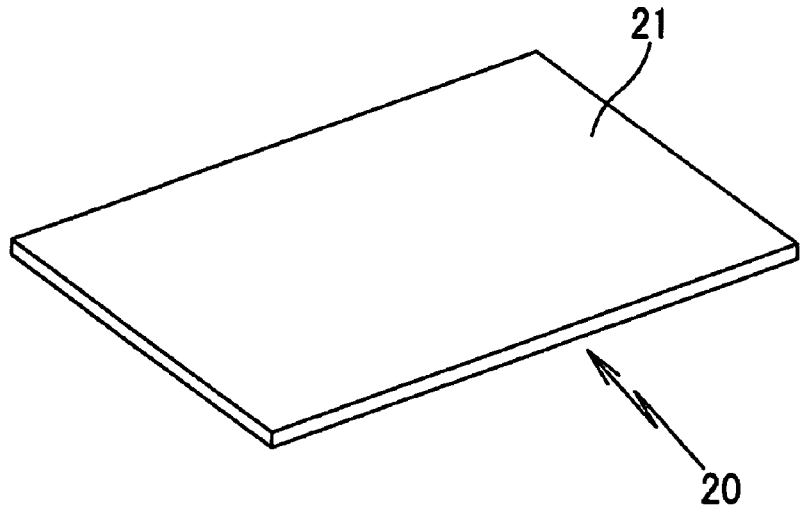
FIG. 2 shows an embodiment of a circuit board.
Figure 2:
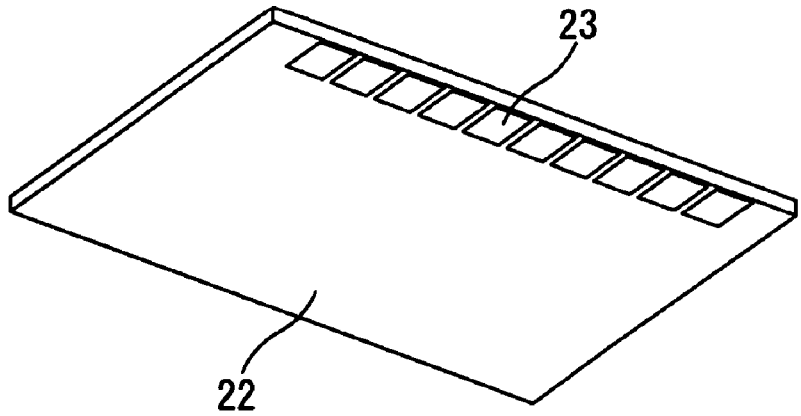
Figure 3:
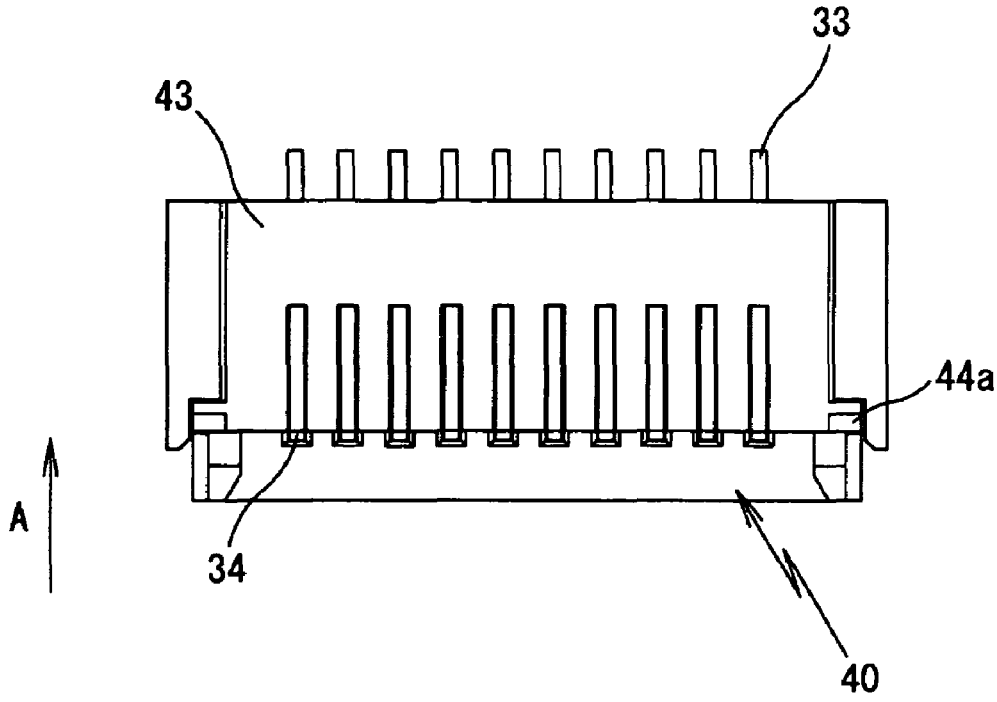
FIG. 3 shows a plane view and a front view showing an electric connector of the present invention.
Figure 3:
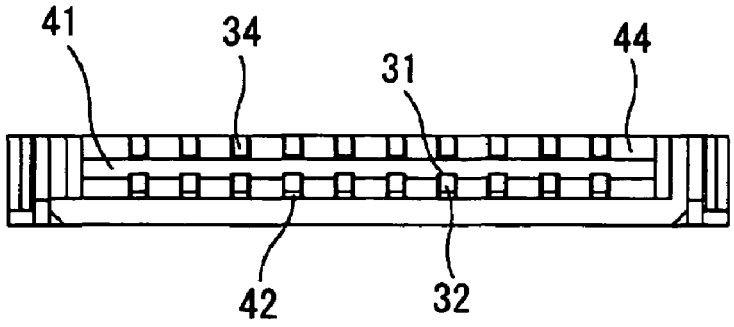

FIG. 3 generally shows the electric connector of the present invention. FIG. 3(*a*) shows a plan view and FIG. 3(*b*) shows a front view. In FIG. 3, the plural contacts 30 and the housing 40 are depicted. Also as described in FIG. 3, each of the plural contacts 30 comprises the contact point 31 which contacts to each of the terminals 23 on the circuit board 20 shown in FIG. 2, the arm part 32 which is contiguous to the contact point 31 and has elasticity, a leg part 33 which is soldered to the contact point of the mother board, and the engage part 34 which engages to the pressure part. The pressure part will be detailed hereinafter. The plural contacts 30 is made from conductive metal so as to provide electric contacts with the circuit board connected. Particularly, the electric signals are transmitted from the contacts of the motherboard to the terminal 23 shown in FIG. 2 through the leg part 33, the arm part 32, and the contact points 31, sequentially.

The engage part 34 of the contact 30 is arranged so as to engage the pressure part (described later) rotatably and the detailed construction of the engage part 34 will be also described later. In the embodiment shown in FIG. 3(*a*), the engage part 34 and a part comprising the surface adjacent to the pressure part which is contiguous to the engage part 34 are exposed; however, these elements may be covered by a cover part described later.

The contact 30 is produced from a thin metal plate such as bronze or copper by punching into desired figures followed by applying plating such as nickel-plating, alloy plating such as tin nickel alloy plating or gold plating. The plating is provided for inhibiting corrosion and the plating may be provided thickly on the contact positions while providing thinner plating on the other positions than the contact positions. For example, such plating may be applied by immersing the contact base material made from a metal thin plate punched into a desired shape, and then depositing plating material on the contact material by electro-plating; however, any apparatus and any method known in the art may be used therefor in the present invention.

Also FIG. 3 shows the housing 40 which comprises the reception recess 41 for receiving one end of the circuit board shown in FIG. 2, the attachment recesses 42 for attaching each of the contacts 30, the cover part 43 which lays down to the insertion direction of the circuit board 20 into the reception recess 41 shown by the arrow A, and the pressure part 44 which is continuous to the cover part 43 and disposed rotatably opposite to the plural contact points 31 while protruding into the reception recess 41 as the cover part 43 is laid down. The pressure part 44 comprises cantilevered axes 44*a* at both end faces thereof. The housing 40 is further disposed with a support recess (not shown) for receiving the axis 44*a* while retaining the axis 44*a* rotatably. In the present invention, the support recess is provided so as to inhibit the pressure part 44 from pushing the pressure part 44 along with the insertion direction of the circuit board without rotating the pressure part 44 when the circuit board is inserted into the reception recess 41 to cause the contact to the pressure part 44. By providing the axis 44*a* and the support recess, the rotation about the axis 44*a* may be ensured and the cover part 43 continuous to the pressure part 44 can be lifted up. The support recess is, for example, may be formed as an U-shaped recess which allows the insertion of the axis 44*a* from the upper side of the housing 40 or the hole which has a concaved shape extending along with the axis 44. In the present invention, the axis 44*a* and the support recess may be omitted so far as the circuit board becomes contact to the pressure part 44 while rotating the pressure part 44 as the insertion of the circuit board so as to lift the cover part up.

FIG. 3 (*b*) shows the contact 31 protruding into the reception recess 41 from the lower side and the cover part 43 is laid down to the direction along with the arrow A. The housing 40 may be made from such as PPS (polyphenylene sulfide) resin, LCP (liquid crystal polymer), polyamide resin, PBT (polybuthylene telephthalate) resin by injecting the plastic materials into a mold followed by cooling and providing hard body to the plastic material. In the present invention, any other insulator materials may be used in order to produce the housing 40.

Figure 4:
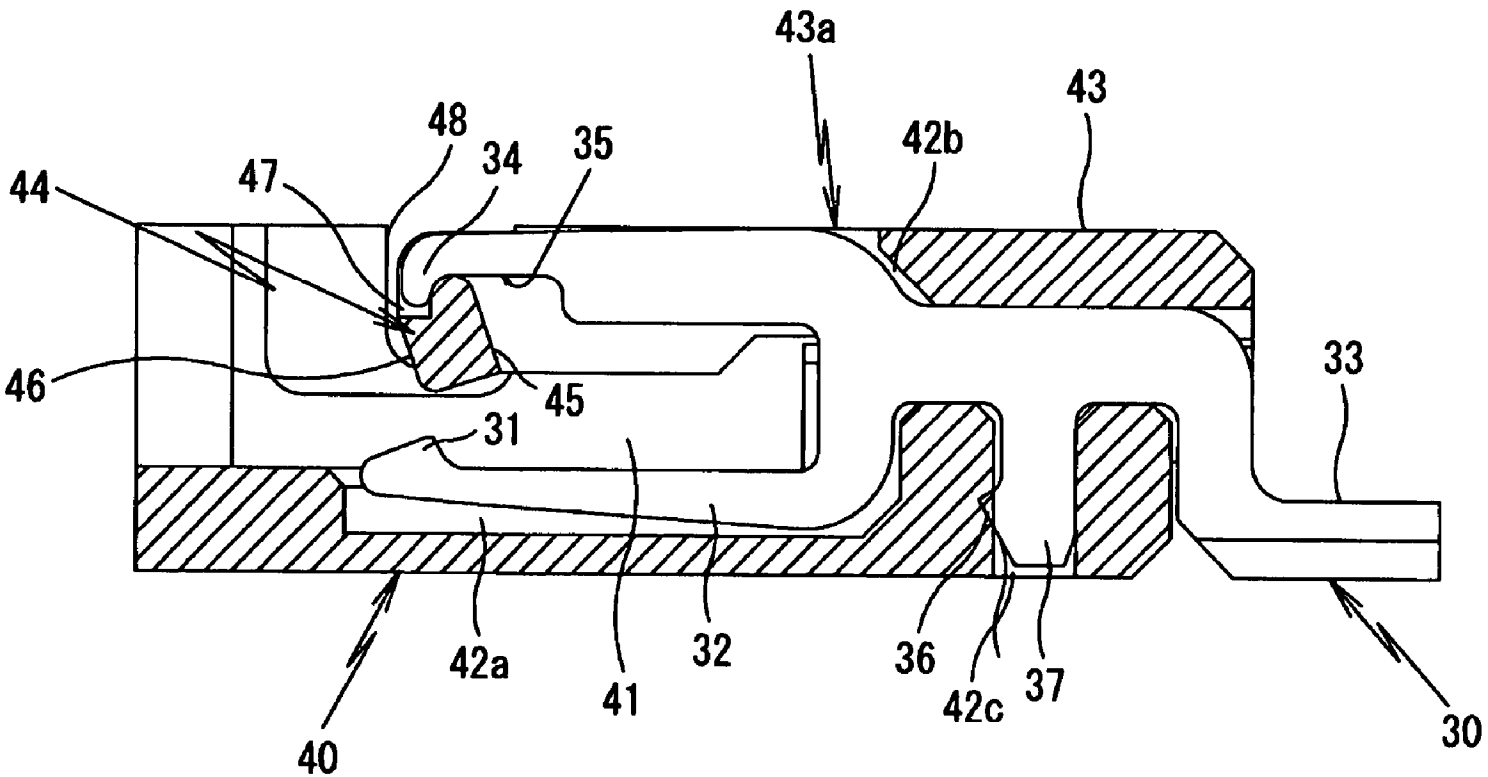
FIG. 4 shows a cross section depicting an electric connector of the present invention.

With referring to the cross section shown in FIG. 4, the electric connector of the present invention will be further detailed. The contact 30 comprises the contact point 31 contacting to the terminal disposed to the circuit board (not shown), the elastic arm part 32 making the contact point 31 movably to up and down directions, being contiguous to the contact point 31 while extending at lower portion in the housing 40, the leg part 33 extending from the housing 40 for soldering to contact points on the motherboard, and the engage part 34 extending as an arch at higher portion in the housing 40 in order to engage with the pressure part 44.

In FIG. 4, the contact 30 further includes the surface adjacent to the pressure part and contiguous to the engage part 34 and the stopper part 37 to which the protrusion 36 is disposed. The protrusion 36 is used to configure the contact 30 on the housing 40 to secure therebetween.

The contact 31 is disposed such that the contact 31 protrudes into the reception recess 41 of the housing 40. The contact 31 has the shape in which the cross section thereof becomes small toward the top so as to ensure the contact to the terminal 23 having one surface while maintaining a predetermined contact pressure. The reduced cross section is provided such that the contact may be ensured even if slight position fluttering in the two dimensional occurs. In the present invention, the top of the contact 31 may be a sharp or rounded shape.

The arm part 32 is placed inside the attachment recess 42 to which the space allowing up and down movement of the arm part 32 is provided. The elasticity of the arm part 32 makes it possible to move the elements as described below; when the circuit board 20 shown in FIG. 2 is not inserted, the arm part 32 supports the contact point 31 such that the contact part 31 protrudes in the reception recess 41; when the circuit board 20 is inserted and the arm part 32 is push down by the pressure part 44 through the circuit board 20, the arm part 32 allows the contact 31 to receive in the attachment recess 42 while retaining the contact to the terminal 23 disposed on the terminal; and when the circuit board is pulled out, the arm part 32 returns the contact point 31 to the original position where the contact point 31 protrudes into the reception recess.

The leg part 33 protrudes from the lower position of the housing 40 opposite to the side to which the reception recess 41 is disposed and extends in the same direction with the insertion direction of the circuit board 20 shown in FIG. 2. The leg part 33 is soldered to the motherboard thereby fixing the electric connector of the present invention is fixed on the motherboard for mounting thereof. In the present invention, the mounting may be attained by bolts and other holes formed in the housing 40 for accepting the bolts therethrough.

The engage part 34 extends as the arch shape and is disposed at the tip extending the upper position in the housing 40 through the reception recess 41. Correspondingly, the engage recesses are disposed to the pressure part 44 at the extension direction of the engage part 34 and the opposite direction thereto such that the engage recesses slidably receive the engage part 34. In order to rotate the pressure part 44 the structure including the engage recess extending along with the engage part 34 and the opposite direction thereto is effective. In addition, as described above, the cantilevered axis 44*a* being disposed to the end face of the pressure part 44, and the support recess disposed to the housing 40 surely enables the rotation of the pressure part 44 about the axis 44*a* surely and adequately upon insertion of the circuit board.

Continuous to the engage part 34, the surface adjacent to the pressure part 35 is disposed. When the pressure part 44 and the contact 30 do not include the planar surface, the pressure part 44 continues to rotate. Therefore, the mechanism for stopping adequately the rotation of the pressure part must be required. In the present invention, the pressure part 44 includes a second plane 45 and the surface adjacent to the pressure part 35 disposed to the position continuous to the engage part 34, thereby preventing excess rotation of the pressure part 44 to stop the rotation thereof with becoming the second plane 45 adjacent to the plural adjacent surface to the pressure part 35 of the plural contacts 30. This is caused by the frictional resistance between the plural adjacent surface 35 to the pressure part of the contacts 30 and the second plane 45 for terminating the rotation. In the present invention, the adjacent surface 35 to the pressure part and the second plane 45 are preferred to have large areas so as to obtain adequate stopping efficiency.

The contact 30 further includes the stopper 37 including the protrusion 36. the protrusion 36 is used to fix the contact 30 to the housing 40. The stopper 37 may not be formed to extend horizontally as the arm part 32 and also the continuous part to the engage part 34 but to be formed vertically thereby ensuring the fixing at a predetermined position so as not to move along with the horizontal direction even if horizontal forces are exerted. In addition, the protrusion 36 is disposed at a vertical predetermined position of the stopper 37, and the protrusion 36 is engaged to a protrusion reception recess disposed to the housing 40, and hence, the adequate fixing may be attained so as not to shift to the vertical direction even if vertical forces are exerted. The stopper 37 including the protrusion 36 may be inserted to a reception recess disposed to the housing 40 by pressing the stopper 37 into the reception recess.

Next, the housing 40 will be explained. The reception recess 41 receives one end of the circuit board 20 shown in FIG. 2 to which the plural terminal 23 are disposed. The plural attachment recess 42 receives each of the arm part 32, the contiguous part to the engage part 34, and the stopper 37 including the protrusion 36 of the plural contacts 30. The arm part reception recess 42*a* receives the arm part 32 and provides the space which allows the elastic arm part 32 to move up and down directions. The arm reception recess 42*a* extends along with the lower position of the housing 40. In addition, the arm reception recess 42*a* is configured contiguous to the reception recess 41 such that the contact point 31 protrudes into the reception recess. The reception recess 42*b*, which retains the part contiguous to the engage part 34, may be configured as an insert-through hole which allows the insertion of the engage part 34. The fixing recess 42*c*, which receives and fixes the engage part 37, may be configured as another fixing recess so that the horizontal and vertical movements thereof may be prohibited. Furthermore, the fixing recess 42*c* includes a correspondingly shaped protrusion fixing recess at the horizontal and vertical position corresponding to the protrusion 36 of the engage part 37. The fixing recess 42*c* has the area which allows fixing of the engagement part 37 and the part including the protrusion 36 can be urged to insert therein.

The cover part 43 is formed and disposed above the reception recess 42*b* which retains the part contiguous to the engage part 34 and has the structure allowing lifting and laying thereof. The cover part 43 may be received in the housing 40 when the cover part 43 is laid down and comprises plural windows such that a portion of the part contiguous to the engage part 43 may be exposed. The cover part 43 can be laid down along with the direction of the circuit board insertion and be lifted up along with the opposite direction thereto. Now, the plural windows 43*a* are disposed so as to engage the engage part 34 to the pressure part 44 likely to a hook.

The pressure part 44 continues to the cover part 43 and is disposed rotatably opposite to the plural contact points 31 of the plural contacts 30, protrudes into the reception recess 41 as the cover 43 is laid down. The pressure part 44, as shown in FIG. 4, has a joined shape of a near rectangular portion with rounded corners and extended to one direction and a circular portion which becomes adjacent to the engage part 34 so that a part of the near rectangular portion thereof extends into the reception recess 41 under that the cover 43 is laid down. In the present invention, the cross sectional shape can not be limited to the embodiment shown in FIG. 4, and the near rectangular shape portion may have any shape such as an ellipse so far as the part thereof protrudes into the reception recess 41 when the cover part 43 is laid down and does not protrude into the reception recess 41 when the cover part 43 is lifted up. Furthermore, in order to increase the friction force and to stop adequately, materials including such as rubber may be adhered on the surface of the pressure part 44 so as to increase the frictional resistance. Alternatively, the pressure part may be formed by faith friction resistance materials such as rubber etc.

Figure 5:
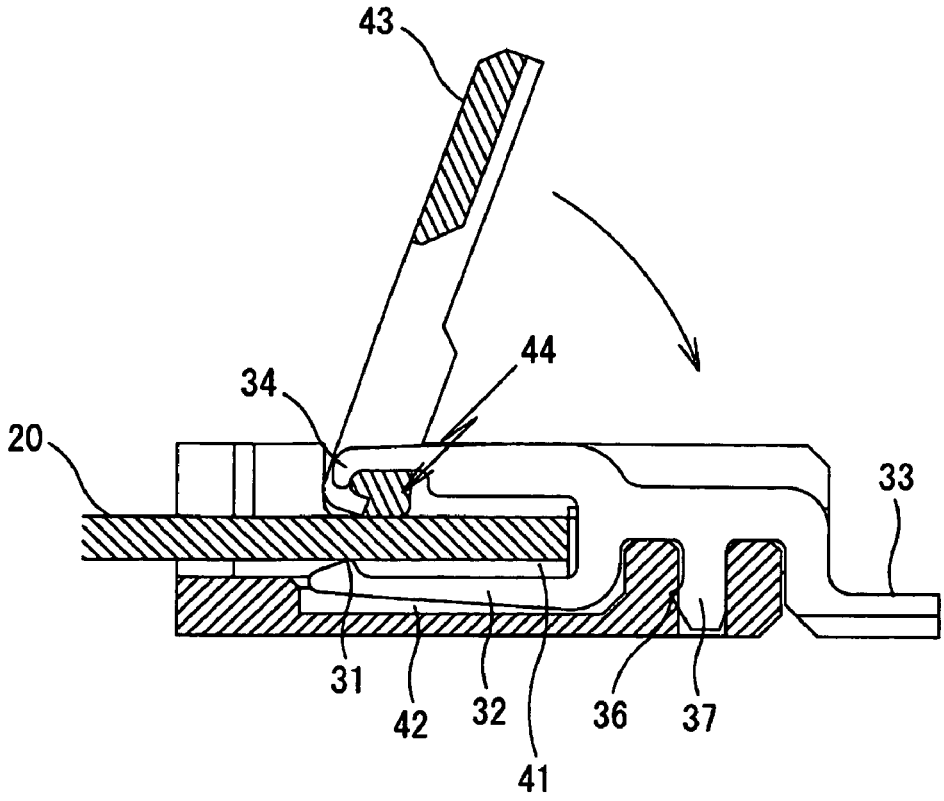
FIG. 5 shows a pressure part and an engage part of an electric connector of the present invention.
Figure 5:
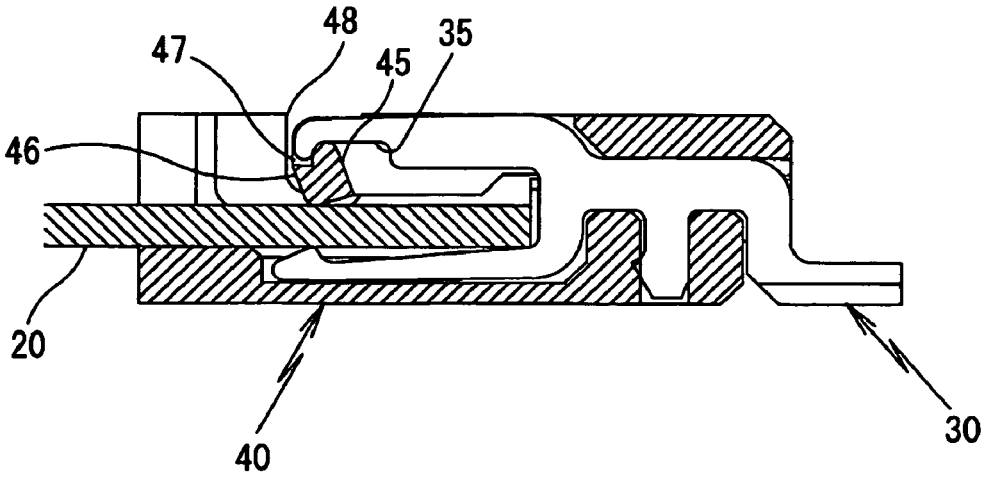

Now, referring to FIG. 5, the pressure part and the engage part will be further detailed. FIG. 5(*a*) shows the part of the pressure part and FIG. 5(*b*) shows the part of the engage part. In FIG. 5(*a*), the cover part contiguous to the pressure part is depicted by broken lines, and in FIG. 5 (*b*), the portion contiguous to the engage part is also depicted by broken lines. The pressure part 44 shown in FIG. 5(*a*) as similar to the embodiment in FIG. 4, the cross section has the joined shape of generally shaped to the rectangular part with rounded corners and with extending to one direction and the half circular part adjacent to the engage part 34 and the shape thereof extends to the direction along which the contacts (not shown) are arranged. In addition, the cantilevered axis parts 44*a* are disposed at both end faces 44*b* of the pressure part which extends along with the direction of the contacts arrangement. The axis part 44*a* has a stick shape and extends to the direction which is the same with the above mentioned arrangement direction from the end face 44*b*. Here, the axis part 44*a* is depicted as the stick shape in FIG. 5(*a*) and the length and the diameter thereof may be determined depending on shapes etc. of the support recess disposed to the housing 40. The pressure part 44 is rotatably placed in the housing 40 and rotates about the axis part 44*a*. The pressure part 44 has rounded corners and when forces are exerted to the lower part thereof, for example, from the direction shown the arrow B of the pressure part 44, the pressure part turns left shown by the arrow C about the rotation center thereof. The pressure part 44 shown in FIG. 5(*a*) also has generally the rectangular cross section and hence, includes a first plane surface 46 and a second plane surface (not shown) at the back side thereof. When these plane surfaces contact to the surface of the circuit board and become contact to the adjacent surface to the pressure part, the plane surfaces become adjacent each other and create large friction resistance so as to terminate the rotation movement of the pressure part 44. According to the present invention, the plane surfaces are construed to provide the state that the cover part 43 contiguous to the pressure part 44 condition at least vertically when these plane surfaces result in the condition adjacent to the above mentioned surface. The engage recess 47 is formed at the surface of the pressure part 44. The engage recess 47 receives slidably the engage part which extends as an arch like shape. The engage recess 47 is construed to the shape corresponding to the shape of the engage part and permits slide movements in the engage recess 47 along with the extension direction of the engage recess 47 and the reverse direction of the extension with respect to the rotation of the pressure part 44. In FIG. 5(*a*), the window 43*a* to which the engage part is inserted when the engage part is installed to a predetermined position is shown.

The engage part 34 shown in FIG. 5(*b*) is shaped into an arch like shape when viewed from the direction of the arrangement of the plural contacts (the direction of the arrow D). The engage parts 34 are retained in the engage recess 47 disposed to the pressure part 44 through the window 43*a* shown in FIG. 5(*a*) so as to allow for engaging the half circular part of the pressure part 44. When the support recess provided to the housing is assumed to have an U shaped recess, the support recess has the simple construction in which the axis part 44*a* is placed therein and the engage part 34 is placed in the engage recess 47 so that the installation and removal thereof may become easy. Furthermore, since the construction permitting the engagement to the half circular portion is provide, the rotation to the lift-up direction for the cover part 43 may become easy. The length of the arch shape of the engage part 34 may be selected to be any length being sufficient to attain engagement with the engage recess 47, and for example, the length may be set to the length corresponding from one fourth to one third of the circle forming the arch. When the arch shape is adopted, the arch may not be a portion of a circle and may be a part of an ellipse or part of a hook.

Figure 1:
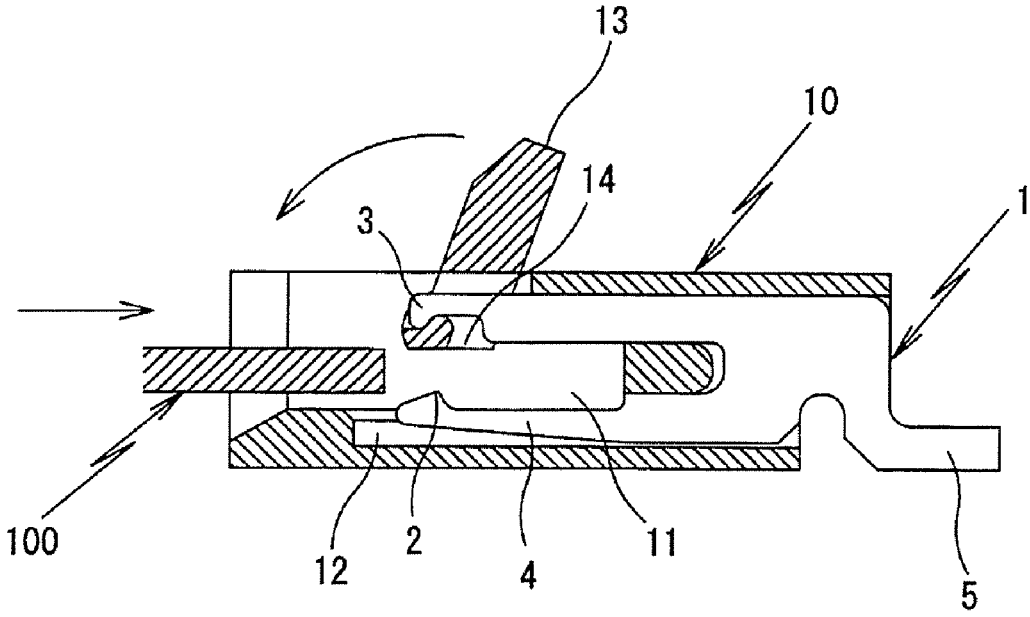
FIG. 1 shows a cross section showing the conventional electric connector.
Figure 1:
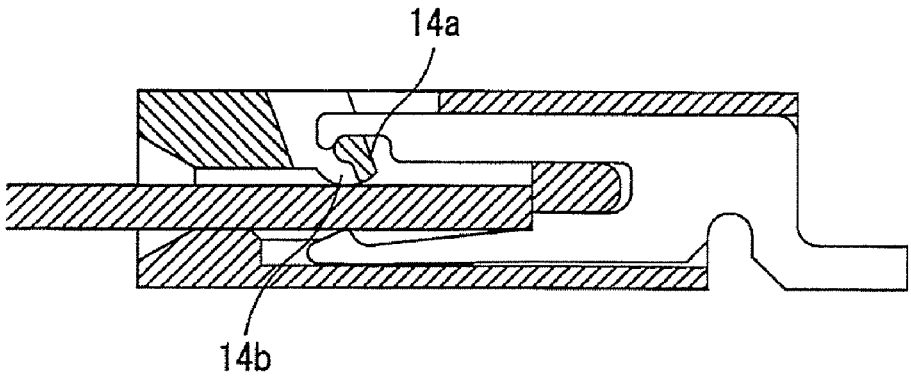
Figure 6:
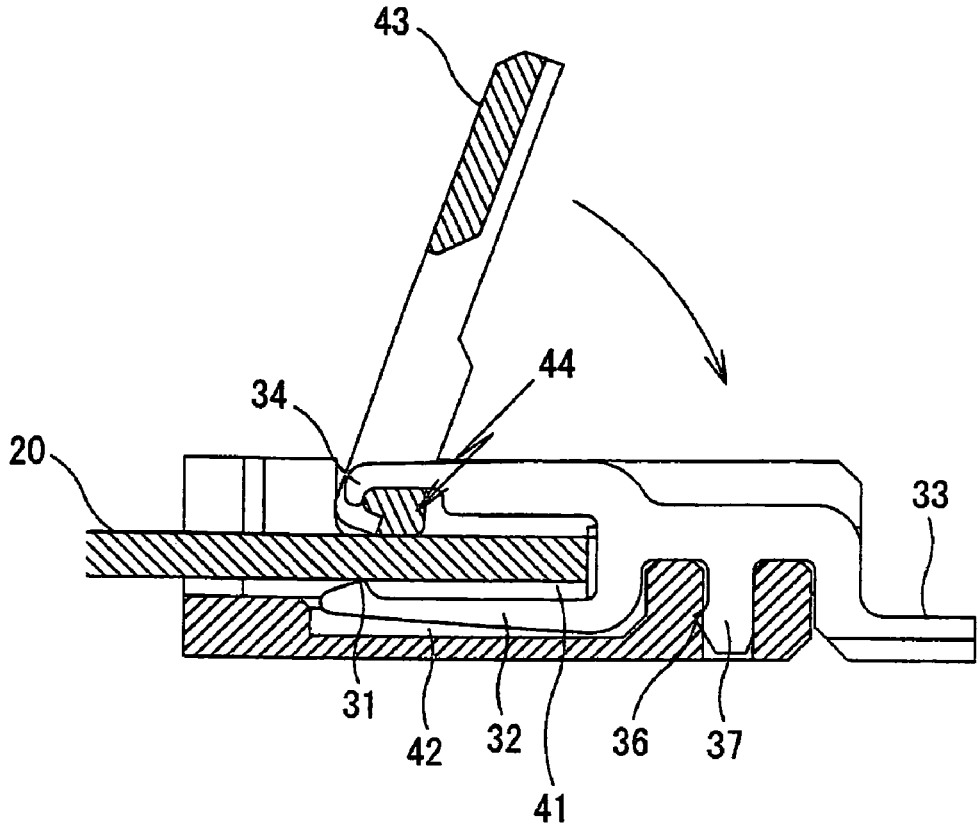
FIG. 6 shows an embodiment for an installation of the circuit board to an electric connector of the present invention.
Figure 6:
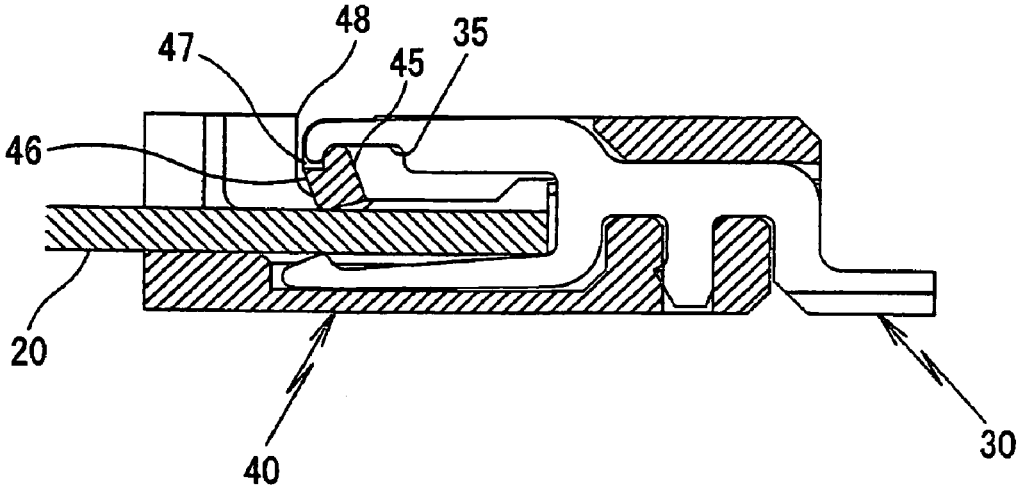

When referring to FIG. 6, the step for installing the circuit board to the electric connector of the present invention will be detailed. In the electric connector shown in FIG. 1, as described above, the circuit board is inserted to the reception recess after lifting the cover part 43. In the present electric connector, there is no necessity to lift the cover part up by using an additional process. As shown in FIG. 6(*a*), the circuit board 20 to which the plural terminals are disposed with a predetermined spacing at one end is inserted into the reception recess 41 and the circuit board 20 becomes contact to the pressure part 44 which protrudes inside the reception recess 41. When the circuit board 20 is further push thereinto, surfaces of the pressure part 44 and the circuit board 20 become adjacent thereby causing the rotation of the pressure part 44 with respect to the insertion of the circuit board 20 and then, the cover part 43 contiguous to the pressure part 44 can be lifted up.

In FIG. 6(*a*), the first plane surface 46 is provided an addition to the second plane surface 45 at the opposite side of the second plane surface 45. When the surface of the inserted circuit board 20 and the first plane surface 46 become adjacent each other, large friction resistance is created to terminate the rotational movement of the pressure part 44. Also the first plane surface 46 may have a plane surface with a large area so as to increase the friction resistance and so as to ensure the termination of the rotational movement.

In the present invention, since the pressure part 44 comprises the first plane surface 46 and the second plane surface 45 and the cover support part 48 which supports the cover part 43 preventing the cover part 43 from the laid-down toward the pull-out direction of the circuit board out. The cover support part 48 may be formed to both ends of the housing 40 along with the direction to which the plural contact 30 is arrayed. The cover support part 48 may have any construction which can support the cover part 43 so as not to be laid down.

In FIG. 6(*a*), when one end of the circuit board 20 is inserted into the reception recess 41, the first plane surface 46 becomes adjacent to the surface of the circuit board 20, and the second plane surface 45 becomes adjacent to the adjacent surface 35 to the pressure part contiguous to each of the engage parts 34 of the plural contact 30. The cover part 43 is consequently supported by the cover support part 48, thereby terminating the rotation movement of the pressure part 44 while stopping the cover part 43 at the standing state. As described above, the electric connector of the present invention the circuit board can be inserted by lifting the cover part up with only one process without requiring an extra process to lift the cover part up. At this time, each of the plural terminals disposed to the circuit board 20 and each of the contact points 31 of the plural contact 30 protruding into the reception recess 41 become contact each other.

Next, as shown in FIG. 6(*b*), the cover part 43 in the stand-up arrangement lays down toward the insertion direction of the circuit board 20. As the cover part 43 is laid down, the pressure part 44 rotates in the reverse direction to the direction when the cover part 43 is lifted up. Furthermore, the pressure part 44 protrudes to the reception recess 41 with respect to the rotation of the pressure part 44. The cover part 43 is laid down to the final position and the cover part 43 is retained in the housing 40. The pressure part 44 protruding into the reception recess 41 pushes the circuit board 20 to the lower side. This push-down continues with maintaining the contacts between each of the plural terminals disposed to the circuit board 20 and each of the contact points 31 of the plural contact 30. Since the forces for recovering the original position by the arm part 32 contiguous to the contact point 31, the contact point 31 maintains the contact to the terminal even if some force is exerted to the circuit board 20 to shift toward the upper direction. The electric connector of the present invention omits any fixing structure for the cover part 43 by providing the condition in that the pressure part 44 is urged to the lower direction by the pressure part 44 and the pressure part 44 rotates to the direction to lay down the cover part 43 when some forces act in the direction by which the circuit board is pulled out.

Herein above, the present invention is explained by referring practical embodiment depicted in the drawings, the present invention can not be limited the depicted embodiments, and any number of contacts, any position where the contact protrude, any cross sectional shape, any shape and size of the cover part, may be adopted.

We claim:

1. An electric connector for providing electric connection to a circuit board, said circuit board comprising plural terminals arrayed at one end and with a predetermined spacing, said electric connector comprising;

plural contacts each including a contact point contacting each of said plural terminals and an elastic arm part contiguous to said contact, a housing including a reception recess retaining said one end of said circuit board and attachment recesses to attach each of said plural contacts, a cover part being laid down toward a direction of insertion of said circuit board, and a pressure part being contiguous to said cover part and being rotatably disposed opposite to said plural contacts, wherein said pressure part protrudes into said reception recess as the cover part is laid down, said pressure part includes a first planar surface that rotates adjacent to said circuit board as said circuit board is inserted into said reception recess, and the rotation of said pressure part terminates when said first planar surface becomes adjacent to said circuit board.

2. The electric connector of claim 1, wherein each of said plural contacts comprises an engage part extending an arch like shape and said pressure part comprises plural engage recesses which slidably retain each of said engage part so as to make said pressure part rotate.

3. The electric connector of claim 1, wherein said pressure part includes cantilevered axis parts at each end surfaces, and said housing supports said axis parts rotatably and includes a support recess to receive said axis part.

4. An electric connector for providing electric connection to a circuit board, said circuit board comprising plural terminals arrayed at one end and with a predetermined spacing, said electric connector comprising;

plural contacts each including a contact point contacting each of said plural terminals and an elastic arm part contiguous to said contact, a housing including a reception recess retaining said one end of said circuit board and attachment recesses to attach each of said plural contacts, a cover part being laid down toward a direction of insertion of said circuit board, and a pressure part being contiguous to said cover part and being rotatably disposed opposite to said plural contacts, wherein said pressure part protrudes into said reception recess as the cover part is laid down, said pressure part includes cantilevered axis parts at each end surface, said housing rotatably supports said axis parts and includes a support recess to receive said axis part, and wherein said pressure part comprises a first planar surface that rotates adjacent to said circuit board as said circuit board is inserted while said rotation thereof terminates when said first planar surface becomes adjacent said circuit board and said housing comprises a cover part support part, and said cover part support part supports said cover part, when lifted, to prevent said cover part from falling toward a direction of pulling out of said circuit board.

5. The electric connector of claim 1, wherein said housing comprises a cover part support part and said cover part support part supports lifted said cover part to prevent said cover part from laying down toward a direction of pulling out of said circuit board.

6. The electric connector of claim 4, wherein said pressure part comprises a second plane surface, and each of said plural contact includes an adjacent surface to said pressure part being contiguous to said engage part and being adjacent to said second plane surface, said rotation of said pressure part is terminated by said adjacent surface to said pressure part of said plural contacts.

7. The electric terminal of claim 1, wherein said contact comprises a stopper including a protrusion, and said attachment recess further comprises a fixing recess being formed to a corresponding shape of said stopper with said protrusion.

* * * * *